US010697706B2

(12) United States Patent
Hughes et al.

(10) Patent No.: US 10,697,706 B2
(45) Date of Patent: Jun. 30, 2020

(54) HEAT EXCHANGER

(71) Applicant: Modine Manufacturing Company, Racine, WI (US)

(72) Inventors: Gregory Gerald Hughes, Milwaukee, WI (US); Michael J. Reinke, Franklin, WI (US); Tony Rousseau, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 1089 days.

(21) Appl. No.: 14/430,787

(22) PCT Filed: Sep. 24, 2013

(86) PCT No.: PCT/US2013/061394

§ 371 (c)(1),
(2) Date: Mar. 24, 2015

(87) PCT Pub. No.: WO2014/052309

PCT Pub. Date: Apr. 3, 2014

(65) Prior Publication Data

US 2015/0233649 A1 Aug. 20, 2015

Related U.S. Application Data

(60) Provisional application No. 61/705,168, filed on Sep. 25, 2012.

(51) Int. Cl.
*F28D 1/04* (2006.01)
*F28D 21/00* (2006.01)
(Continued)

(52) U.S. Cl.
CPC ..... *F28D 1/0426* (2013.01); *F28D 7/0025* (2013.01); *F28D 21/0003* (2013.01); *F28F 3/027* (2013.01); *F28F 2265/26* (2013.01)

(58) Field of Classification Search
CPC ..... F28D 1/0408; F28D 1/0461; F28D 1/0426
See application file for complete search history.

(56) References Cited

U.S. PATENT DOCUMENTS 2,617,634 A 11/1952 Jendrassik
3,830,290 A 8/1974 Thamasett et al.
(Continued)

FOREIGN PATENT DOCUMENTS

DE 4403144 3/1995
EP 0981035 2/2000
(Continued)

OTHER PUBLICATIONS

Office Action from the US Patent and Trademark Office for U.S. Appl. No. 14/430,796 dated Aug. 25, 2016 (15 pages).
(Continued)

*Primary Examiner* — Hung Q Nguyen
*Assistant Examiner* — Mark L. Greene
(74) *Attorney, Agent, or Firm* — Michael Best & Friedrich LLP; Jeroen Valensa; Michael Bergnach

(57) ABSTRACT

A heat exchanger that includes first and second headers, a first flow conduit fluidly connecting the first and second headers to allow for a flow of a first fluid through the heat exchanger, the first flow conduit being bounded by a first generally planar wall section extending between the first and second headers, a second flow conduit to allow for a flow of the second fluid through the heat exchanger, the second flow conduit being bounded by a second generally planar wall section spaced apart from the first generally planar wall section to define a gap therebetween, and a thermally conductive structure arranged within the gap and joined to the first and second generally planar wall sections to transfer heat therebetween. The thermally conductive structure is isolated from the first fluid by the first generally planar wall
(Continued)

section and from the second fluid by the second generally planar wall section.

11 Claims, 8 Drawing Sheets

(51) Int. Cl.
*F28D 7/00* (2006.01)
*F28F 3/02* (2006.01)

(56) References Cited

U.S. PATENT DOCUMENTS

| | | | | |
|---|---|---|---|---|
| 4,002,201 | A | 1/1977 | Donaldson | |
| 4,177,858 | A | 12/1979 | Daman et al. | |
| 4,249,593 | A | 2/1981 | Bieberbach et al. | |
| 4,448,243 | A | 5/1984 | Pain | |
| 5,416,323 | A | 5/1995 | Hoots et al. | |
| 6,250,380 | B1 | 6/2001 | Strahle et al. | |
| 6,817,406 | B1 | 11/2004 | Inoue et al. | |
| 7,610,949 | B2 | 11/2009 | Palanchon | |
| 7,896,066 | B2 * | 3/2011 | Higashiyama | F28D 1/05391 165/174 |
| 8,783,335 | B2 | 7/2014 | Suzuki et al. | |
| 2009/0025916 | A1 | 1/2009 | Meshenky et al. | |
| 2009/0260775 | A1 | 10/2009 | Maucher et al. | |
| 2010/0126172 | A1 | 5/2010 | Sami | |
| 2010/0300651 | A1 | 12/2010 | Kumar et al. | |

FOREIGN PATENT DOCUMENTS

| | | |
|---|---|---|
| JP | 2011132570 | 7/2011 |
| WO | WO2012045845 | 4/2012 |

OTHER PUBLICATIONS

International Search Report and Written Opinion for Application No. PCT/US2013/061394 dated Feb. 18, 2014 (6 pages).
International Search Report and Written Opinion for Application No. PCT/US2013/061395 dated Feb. 21, 2014 (6 pages).
David B. Sarraf, Heat Pipe Heat Exchanger with Two Levels of Isolation for Environmental Control of Manned Spacecraft Crew Compartment, SAE Technical Paper 2006-01-2163, published Jul. 17, 2006 (9 pages).
Office Action from the US Patent and Trademark Office for U.S. Appl. No. 14/430,796 dated Jul. 20, 2017 (13 pages).
Office Action from the US Patent and Trademark Office for U.S. Appl. No. 14/430,796 dated Mar. 6, 2017 (13 pages).
United States Patent Office Action for U.S. Appl. No. 14/430,796 dated Jan. 30, 2018 (14 pages).
United States Patent Office Action for U.S. Appl. No. 14/430,796 dated Aug. 29, 2018 (15 pages).

* cited by examiner

HEAT EXCHANGER

CROSS-REFERENCE TO RELATED APPLICATIONS

This application claims priority to Provisional Patent Application No. 61/705,168 filed on Sep. 25, 2012, the entire contents of which are incorporated herein by reference.

STATEMENT REGARDING FEDERALLY SPONSORED RESEARCH OR DEVELOPMENT

This invention was made with government support under DOE Program Award No. EE0003403 "Recovery Act—System Level Demonstration of Highly Efficient and Clean, Diesel Powered Class 8 Trucks (SUPERTRUCK)". The government has certain rights in the invention.

BACKGROUND

The invention relates to heat exchangers, and particularly, to heat exchangers for removing heat from high temperature gases, such as an exhaust gas.

Heat exchangers to remove heat from a stream of exhaust gas or other elevated temperature gas are well known. As one example known in the art, exhaust gas recirculation (EGR) coolers are used in combination with internal combustion engines operating on the Diesel or the Otto cycle (among others) to lower the temperature of a portion of the exhaust produced by the engine, so that that portion of the exhaust can be recirculated back to the air intake manifold of the engine. Such recirculation of exhaust gas is known to be effective in reducing the amount of a known pollutant (oxides of nitrogen) produced during the combustion process.

A typical EGR cooler of the kind described above is depicted in FIG. 1. The cooler 101 provides a flow path, extending from an exhaust inlet 102 to an exhaust outlet 103, for a stream of exhaust gas received from the engine. The exhaust gas is received into an inlet manifold 104 adjacent to the exhaust inlet 102, and is distributed to several fluid conveying tubes that extend from the inlet manifold 104 to a similar outlet manifold 105 arranged adjacent to the exhaust outlet 103. A casing 108 extends from the inlet manifold 104 to the outlet manifold 105 and provides a cooling water jacket surrounding the exhaust conveying tubes. Circuited cooling water is directed through the cooling water jacket by way of coolant ports 106 and 107, so that the exhaust gas traveling through the cooler 101 is reduced in temperature by the transfer of heat to the circuited cooling water.

While heat exchangers such as cooler 101 of FIG. 1 may be suitable for their intended purpose of cooling an exhaust gas, they are far from perfect. As one example, harsh mechanical stresses are often imposed on the heat exchanger by the cyclic thermal expansions and contractions that it experiences over its operational lifetime. These mechanical stresses can, at least in part, be the result of the differences in thermal expansion between the relatively cool casing 108 and the relatively hot fluid conveying tubes, and can lead to premature structural failure of the cooler 101 (e.g. a breach in the separation of the exhaust gas from the coolant). Thus, there is still room for improvement.

SUMMARY

In one embodiment of the invention, a heat exchanger is provided to transfer heat between a first and a second fluid.

The heat exchanger includes headers arranged at opposing ends of the heat exchanger, and a first flow conduit that fluidly connects the headers to allow the first fluid to flow through the heat exchanger. The first flow conduit is bounded by a first generally planar wall section extending between the first and second headers. A second flow conduit allows a second fluid to flow through the heat exchanger, and is spaced away from at least one of the headers. The second flow conduit is bounded by a second generally planar wall section which is spaced apart from the first generally planar wall section so that a gap is defined between the wall sections. A thermally conductive structure is arranged in the gap and is joined to the two wall sections so that heat can be transferred between them. The thermally conductive structure is isolated from the first fluid by the first generally planar wall section and from the second fluid by the second generally planar wall section.

According to some embodiments, the second flow conduit is spaced away from both of the headers. In some embodiments channels defined by the thermally conductive structure and the wall sections are included in the gap. In some embodiments the channels extend in a direction that is transverse to the length direction defined by the opposing headers. In some embodiments each of the channels is bounded by exactly one of the wall sections.

According to some embodiments, the thermally conductive structure includes a corrugated sheet. In some embodiments, the thickness of the corrugated sheet is no more than half of the thickness of one of the wall sections.

In one embodiment of the invention, a heat exchanger includes headers arranged at opposing ends of the heat exchanger, and flat tubes extending between the headers. A first end of each tube extends through a corresponding tube slot in the first header, and a second end of each tube extends through a corresponding tube slot in the other header. Plate assemblies are interleaved with the tubes between the two headers, and thermally conductive structures are arranged in gaps between adjacent tubes and plate assemblies. The thermally conductive structures join opposing external surfaces of the tubes and plate assemblies in order to transfer heat between them.

According to some embodiments, the plate assemblies are spaced apart from at least one of the headers. In some embodiments, channels defined by the thermally conductive structures and the external surfaces are included between adjacent ones of the tubes and plate assemblies. In some embodiments the channels extend in a direction that is transverse to a tube-axial direction of the tubes. In some embodiments the thermally conductive structures include corrugated sheets.

In one embodiment of the invention. a heat exchanger is provided to transfer heat between two fluids. The heat exchanger includes a first set of flow conduits to transport the first fluid through the heat exchanger, and a second set of flow conduits interleaved with the first set to transport the second fluid through the heat exchanger. Intermediate structures are arranged between adjacent ones of the flow conduits to provide thermal and structural connections between the flow conduits. The intermediate structures include a sacrificial fatigue location during thermal cycling of the heat exchanger.

According to some embodiments, thermally induced stresses are relieved by cracking at the sacrificial fatigue location. In some embodiments the intermediate structures are joined to generally planar wall sections that are part of the first and second sets of flow conduits.

According to some embodiments the intermediate structures include formed sheets. In some embodiments the material thickness of the sheets are no greater than half of the thickness of the generally planar wall sections. In some embodiments the intermediate structures and the wall sections define channels, and in some embodiments the channels are bounded by exactly one of the generally planar wall sections.

According to some embodiments, the heat exchanger includes an inlet manifold and an outlet manifold for the first fluid. In some embodiments the second set of flow conduits is spaced away from at least one of the manifolds.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 2:
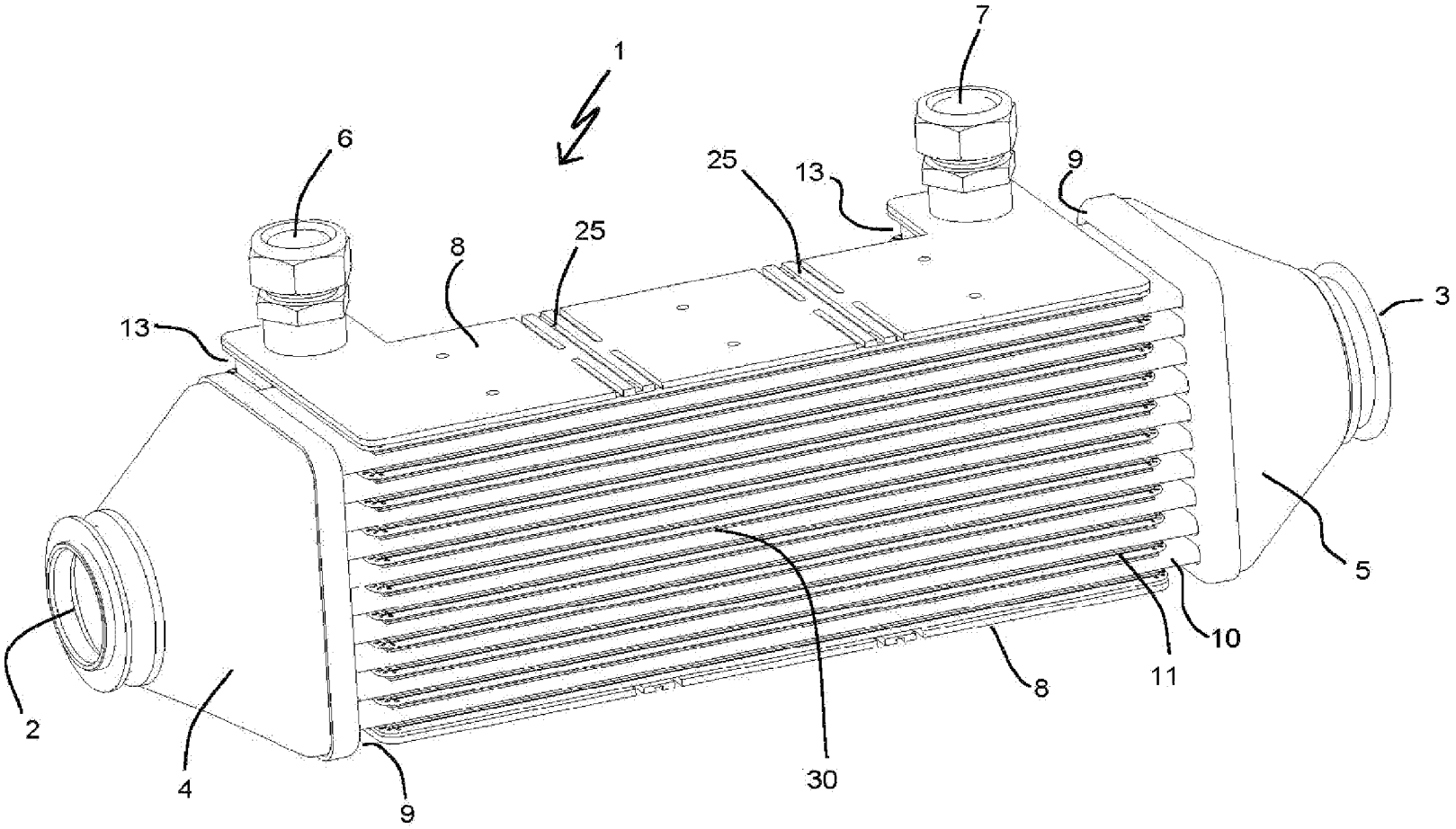
FIG. 2 is a perspective view of a heat exchanger according to an embodiment of the invention.

An embodiment of a heat exchanger 1 according to an embodiment of the invention is shown in FIG. 2, and includes a first flow path for a first fluid extending between an inlet port 2 and an outlet port 3. An inlet manifold 4 is coupled to the inlet port 2 to receive a flow of the first fluid therefrom. An outlet manifold 5 is coupled to the outlet port 3 to deliver a flow of the first fluid thereto. A plurality of tubes 10 extend between the inlet manifold 4 and the outlet manifold 5, and serve as flow conduits to transport the first fluid from the inlet manifold 4 to the outlet manifold 5. While the exemplary embodiment includes ten of the tubes 10, it should be understood that other embodiments of the invention can include more or fewer tubes 10, as may be desirable for the particular application.

The tubes 10 extend into the manifolds 4, 5 through headers 9 arranged at opposing ends of the heat exchanger 1. The headers 9 each define a boundary wall of one of the manifolds 4, 5. In some embodiments the header 9 can be formed integrally with a manifold 4 or 5, while in other embodiments the header 9 can be formed as a separate component that is assembled to the remainder of the manifold 4 or 5. As one example, the header 9 can be formed from flat sheet steel and can be brazed or welded to an open end of a casting to define a manifold 4 or 5. As another example, a header 9 can be provided with mechanical mounting features to allow for assembly of the heat exchanger 1 into a system, with the remainder of the manifold 4 or 5 being provided as part of the piping for the first fluid.

Figure 6:
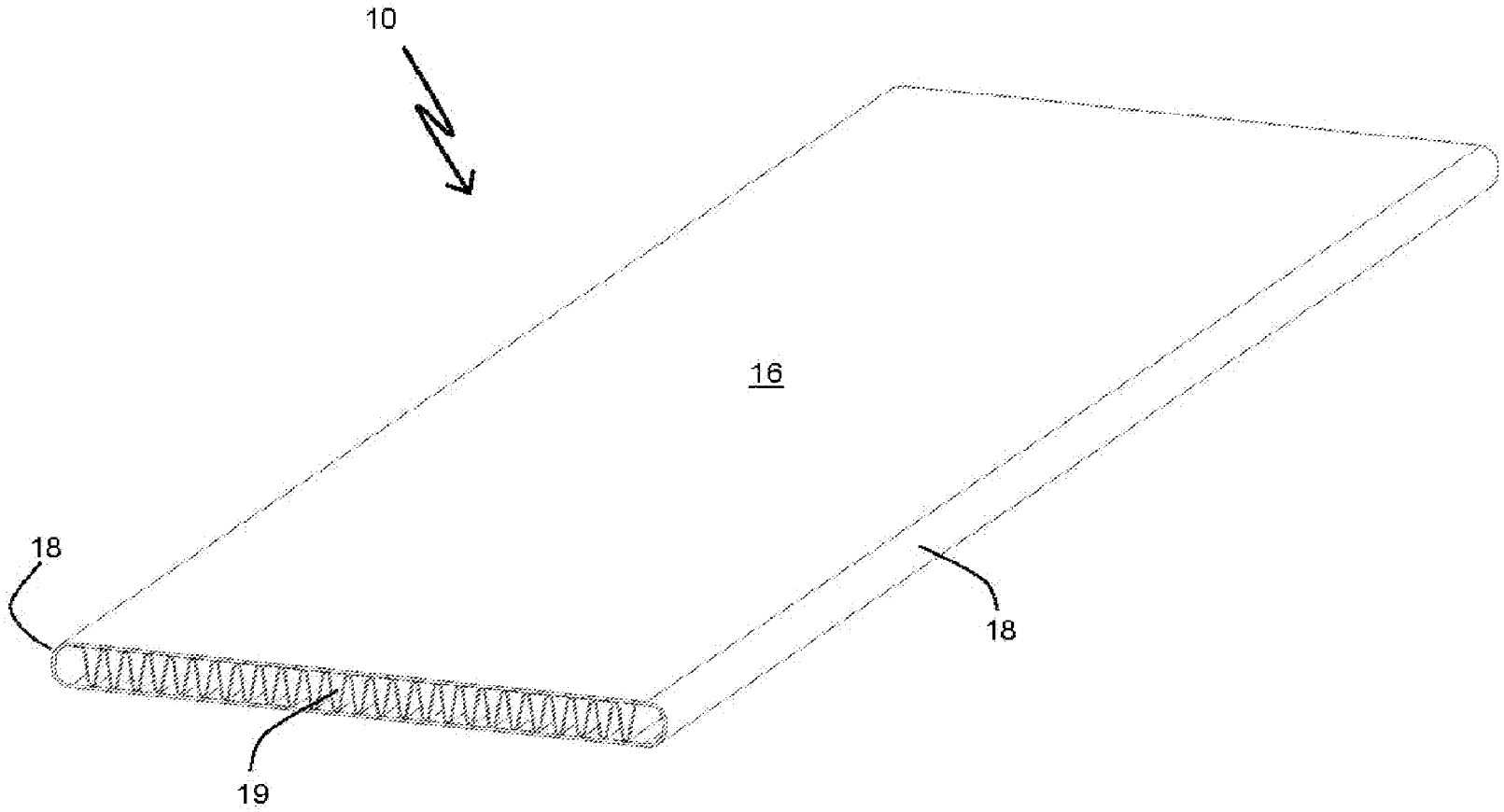
FIG. 6 is a perspective view of a tube and insert for use in the heat exchanger of FIG. 2.

An example of a single tube 10 as used in the exemplary heat exchanger 1 is depicted in FIG. 6. As shown therein, the tube 10 includes a pair of opposing broad and planar walls 16, spaced apart and joined by a pair of short walls 18. The short walls 18 are depicted as arcuate in profile, although in some other embodiments the short walls can have a straight or other non-arcuate profile. The tube 10 can be formed as a single piece from sheet steel, such as by seam welding a round tube from sheet steel and then flattening the tube to produce the pair of broad and flat walls 16 and the pair of short walls 18. Alternatively, the tube 10 can be formed from more than one piece. An insert 19 is preferably provided internal to the tube 10. The insert 19 can provide one or more benefits, including (but not limited to) increasing the internal surface area for improved heat transfer, turbulating the flow of the first fluid for increased heat transfer, and strengthening the tube walls 16. It should be understood by those skilled in the art that the insert 19, if present, can take on any number of forms known in the art, including square wave, serpentine, sine wave, lanced and offset, etc.

Interleaved with the tubes 10 are a plurality of plate assemblies 11. The plate assemblies 11 serve as flow conduits to transport a second fluid through the heat exchanger 1. The plate assemblies 11 are in fluid communication with a pair of manifolds 13 for the second fluid. Fluid ports 6 and 7 are connected to the manifolds 13, and allow for the second fluid to be delivered to and received from the heat exchanger 1.

Figure 1:
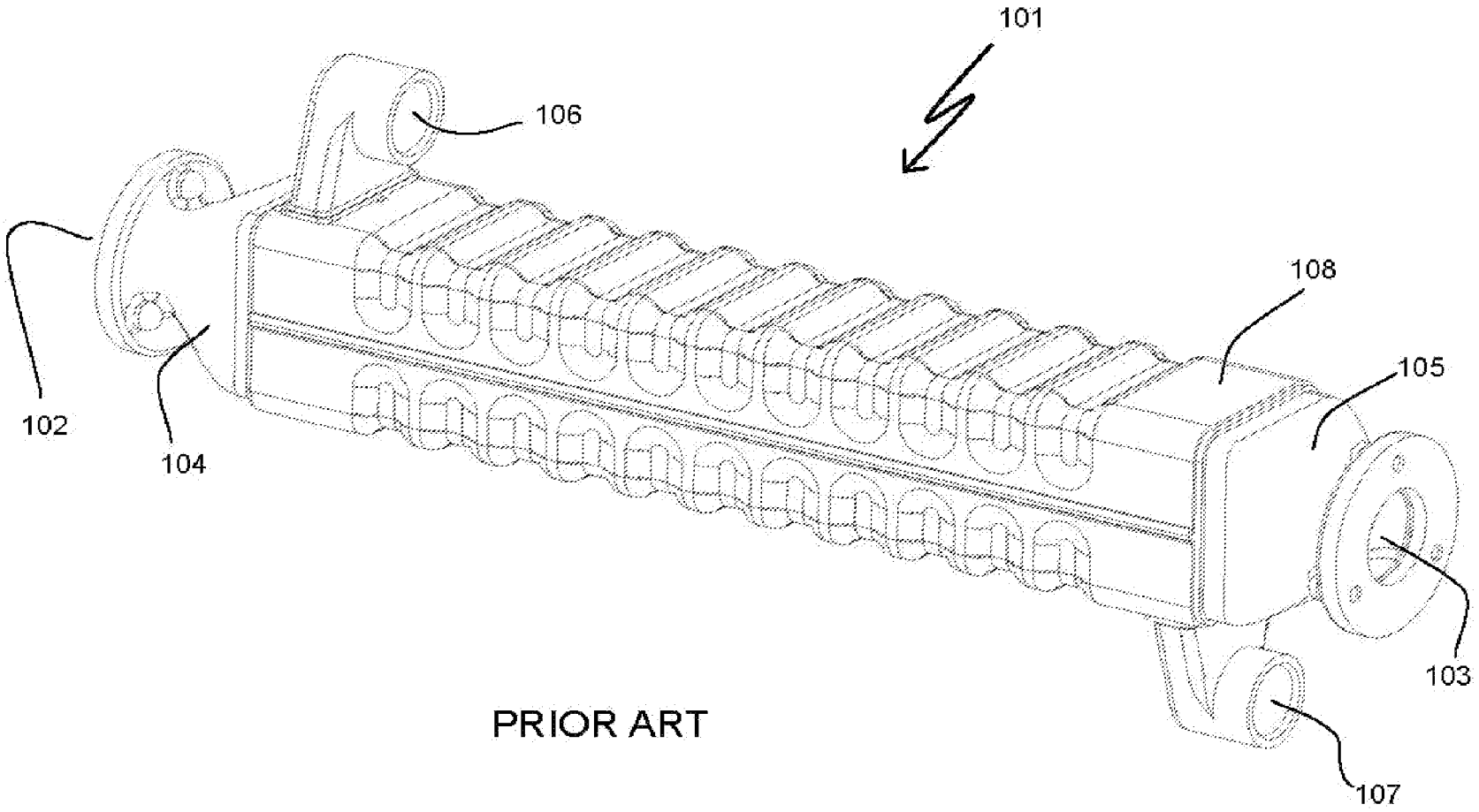
PRIOR ART Fig. 1
FIG. 1 is a perspective view of a prior art heat exchanger.

In the exemplary embodiment of FIG. 1, the fluid port 6 is arranged at a common end of the heat exchanger 1 with the first fluid inlet port 2. Similarly, the fluid port 7 is arranged at a common end of the heat exchanger 1 with the first fluid outlet port 3. This arrangement allows for the first and second fluids to be circuited through the heat exchanger 1 in either an overall counter-flow arrangement (by flowing the second fluid into the heat exchanger 1 through the port 7 and removing it through the port 6) or an overall concurrent-flow arrangement (by flowing the second fluid into the heat exchanger 1 through the port 6 and removing it through the port 7). Other arrangements of the fluid ports 6, 7 are also possible, and will be explained in greater detail below.

Figure 7:
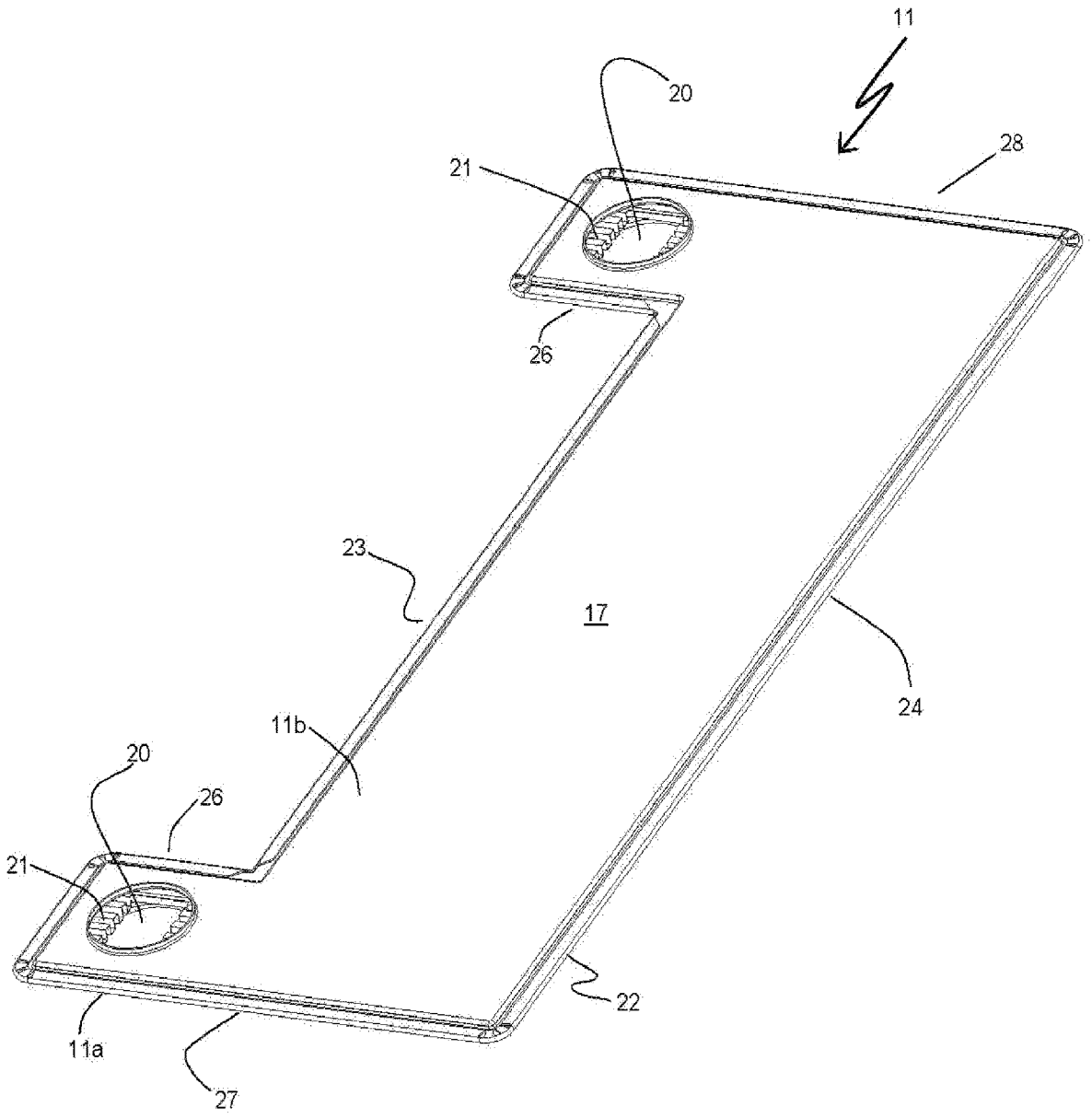
FIG. 7 is a perspective view of a plate assembly for use in the heat exchanger of FIG. 2.

An example of a single plate assembly 11 as used in the exemplary heat exchanger 1 is depicted in FIG. 7. As shown therein, the plate assembly 11 is of a two-piece construction, with a first plate half 11*a* joined to a second plate half 11*b*. Each of the plate halves 11*a, b* include a large planar wall section 17 spaced apart from the center of the plate assembly 11, so that a flow conduit for the second fluid is provided between the opposing wall sections 17 of a plate assembly 11. A crimped joint 22 is provided along the periphery of the plate assembly 11 to join the plate halves 11*a, b* together. The crimped joint 22 can be seen in greater detail in FIG. 5.

While the crimped joint 22 is shown to be located at approximately the mid-plane of the plate assembly 11, it could alternatively be located so as to be essentially coplanar with one of the wall sections 17. Further, while the exemplary embodiment shows a two-piece assembly with a crimp joint, the plate assembly 11 can alternatively be constructed using more components. For example, the plate halves 11*a* and 11*b* can be replaced by flat plates, and a spacer frame could be provided between the flat plates to provide the flow conduit for the second fluid.

Apertures 20 are provided in the plate halves 11*a, b* in the regions of the manifolds 13 to provide for fluid communication between the manifolds 13 and the internal flow conduit between the wall sections 17. The apertures 20 are provided in extensions 26 that extend off of a longitudinal edge 23 of the plate assembly 11. In some alternative embodiments, one or both of the extensions 26 could instead extend off of the opposite longitudinal edge 24. Further, while the exemplary embodiment shows the extensions 26 arranged at the ends 27 and 28 of the plate assembly 11, it should be understood that they could be arranged at any location along the edge 23 or the edge 24. In some embodiments it may be preferable, for example, for at least one of the extensions 26 to be spaced a distance away from an end 27 or 28. Such an arrangement could provide, for example, for an alternative relative flow arrangement between the two fluids, such as a cross-flow arrangement or a combination of counter-flow and concurrent-flow.

An internal flow structure 21 can be arranged within the flow conduit for the second fluid, and can be used to direct the second fluid through the flow conduit between the apertures 20. The internal flow structure can be embodied in any number of forms, including as a stamped flow sheet, a single corrugated fin structure, multiple corrugated fin structures, lanced and offset fin structures, etc. The internal flow structure 21 is optional, however, and in some embodiments it may be preferable to dispense with the internal flow structure 21 in order to provide a more open flow conduit for the second fluid. In such alternative embodiments it may be desirable to provide other features in the plate assembly 11 in order to maintain the spacing between the wall sections 17 and/or to provide structural support. As one example of such features, inwardly facing dimples can be provided on one or both of the plate halves 11 *a, b*.

Figure 3A:
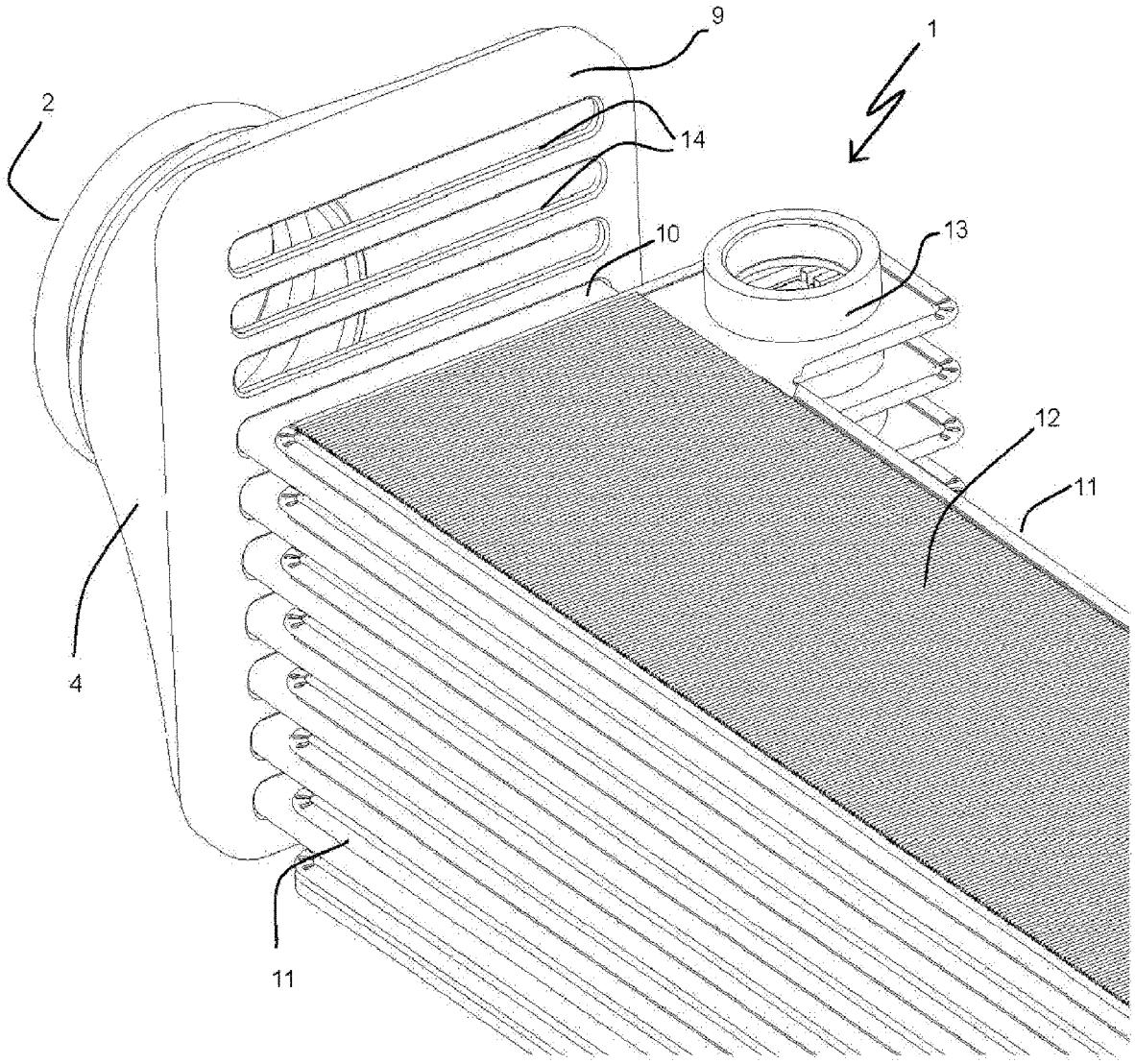
FIGS. 3A and 3B are partial perspective views of certain portions of the heat exchanger of FIG. 2.

Turning now to FIGS. 3A-5, the construction of the heat exchanger 1 will be explained in greater detail. FIGS. 3A and 3B both show the first fluid inlet end of the heat exchanger 1, with certain components removed for clarity in describing specific aspects of the heat exchanger 1.

Figure 3B:
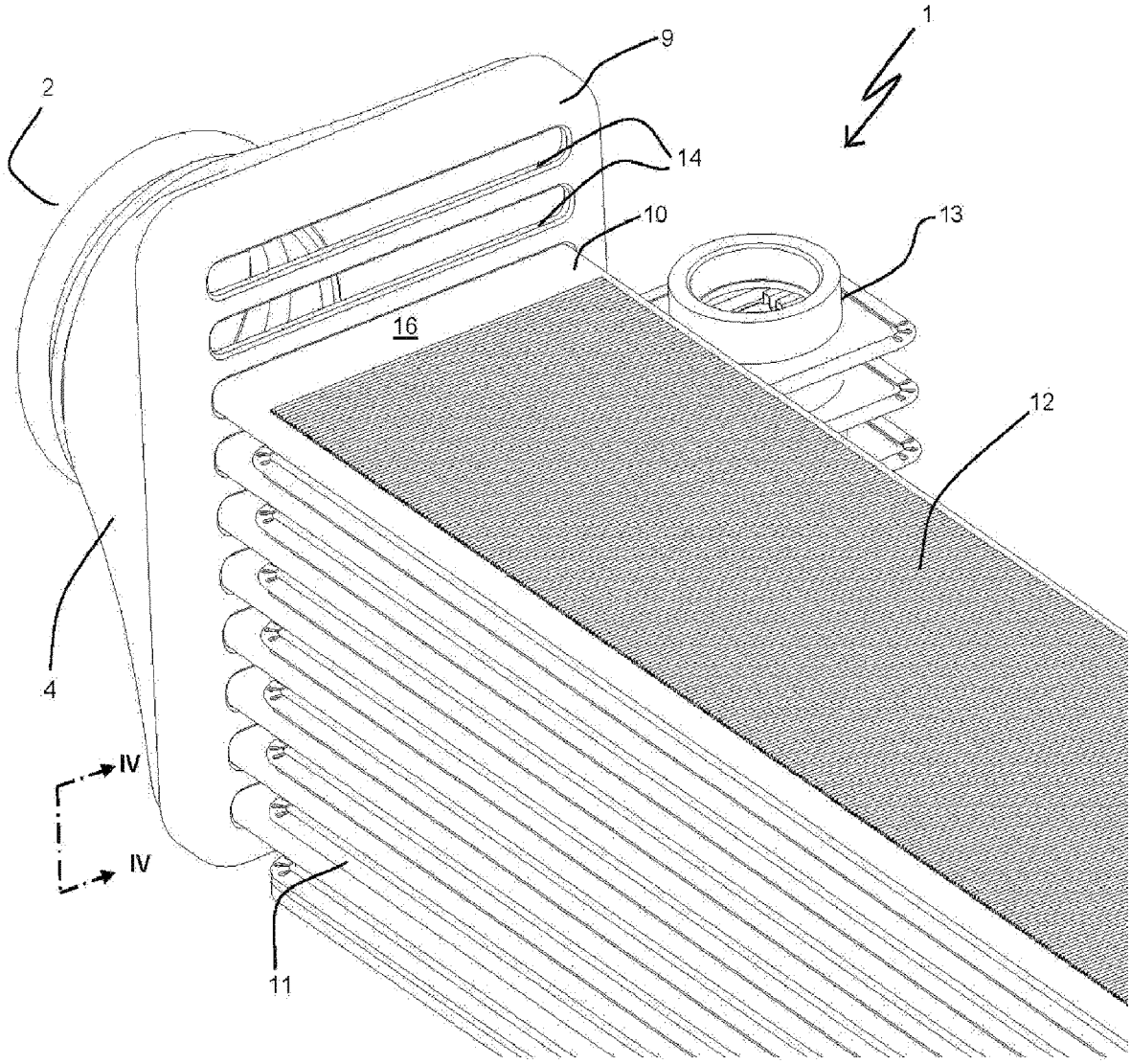

As shown in FIGS. 3A and 3B, the header 9 is provided with a plurality of tube slots 14, each sized and arranged to receive an end of a tube 10 so as to fluidly connect the flow conduit arranged within the tube 10 to the manifold 4. The plate assemblies 11 are interleaved with the tubes 10, as previously discussed. In addition, a structure 12 is provided between adjacent ones of the plate assemblies 11 and tubes 10. The structures 12 are provided as corrugated metal sheets, with the corrugations extending in a direction that is transverse to the flow direction of the first fluid through the heat exchanger 1.

Figure 4:
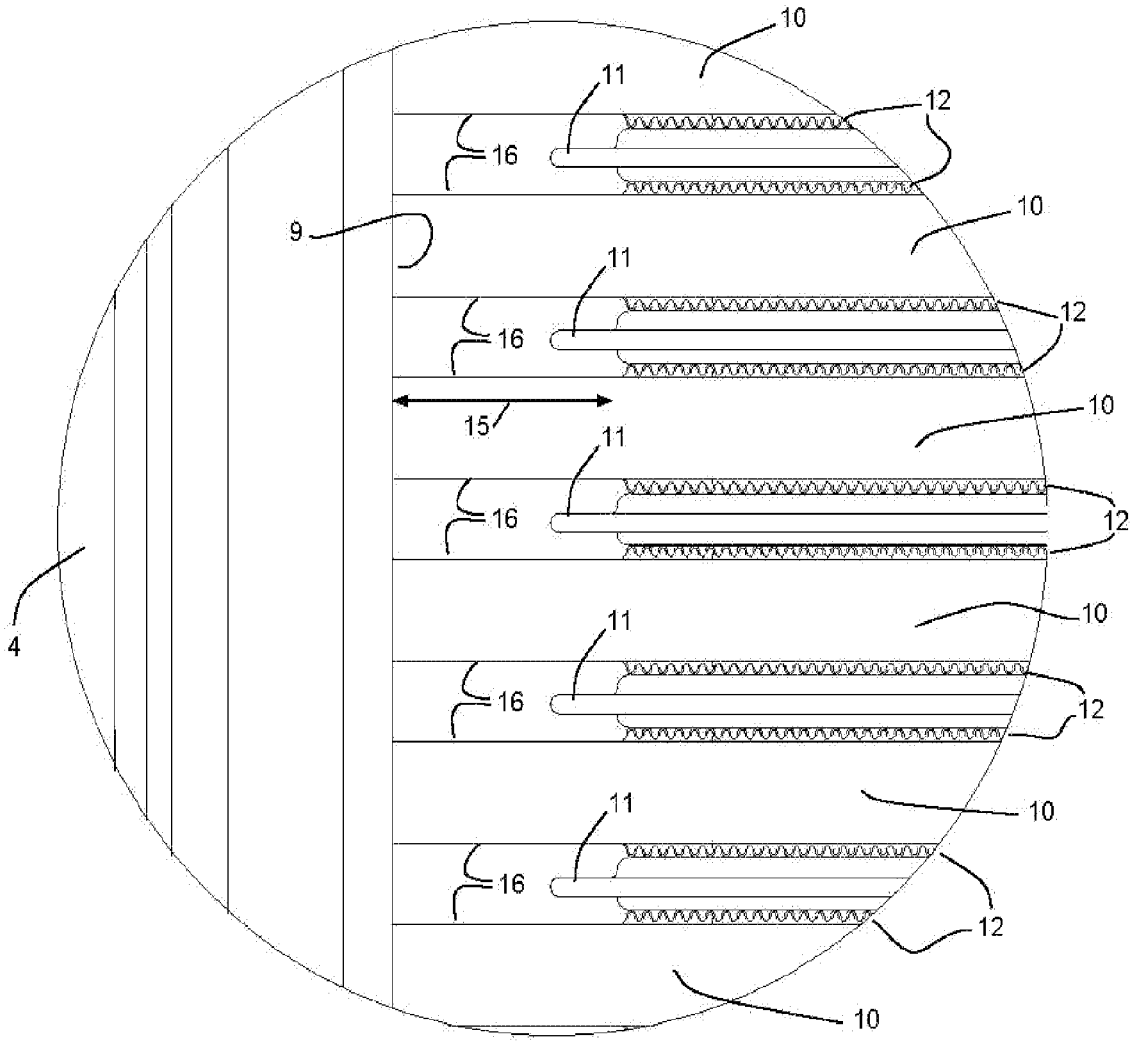
FIG. 4 is a detail view of a region of the heat exchanger of FIG. 3B, as viewed in the direction indicated by the arrows IV-IV.
Figure 5:
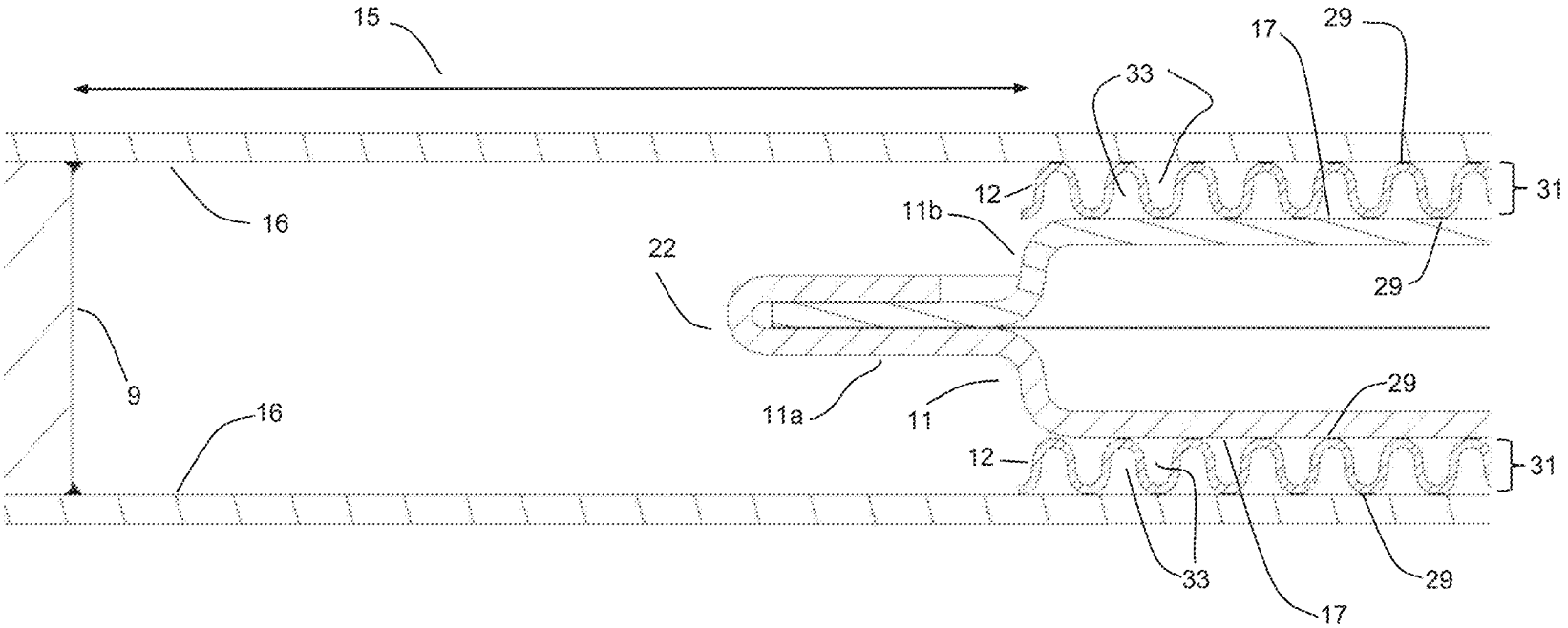
FIG. 5 is a partial cross-section view of a repeating portion of the heat exchanger of FIG. 2.

The structures 12 (as best seen in FIGS. 4 and 5) are placed within gaps 31 between the flat walls 16 of the tubes 10 and the adjacent flat wall sections 17 of the plate assemblies 11. The corrugations of the structure 12 define troughs and crests 29, which are alternatingly in contact with a wall 17 and a wall 16. Together, the plurality of tubes 10, plate assemblies 11, and structures 12 define a stack 30. The components of the stack 30 are preferably joined together into a monolithic assembly by metallurgically joining the crests and troughs 29 of the structures 12 to the adjacent walls 16, 17. Such metallurgical joining can be efficaciously accomplished by furnace brazing the components together. In some especially preferable embodiments, other components of the heat exchanger 1 can be simultaneously joined in the same process. For example, the ends of the tubes 10 can be sealingly joined to the headers 9; the plate halves 11*a* and 11*b* and the optional internal flow structure 21 can be joined; the inserts 19 can be joined to the tubes 10; and/or the manifolds 13 can be joined to the plate assemblies 11.

Since the first fluid is directed through the first flow conduits formed by the tubes 10, and the second fluid is directed through the second flow conduits formed by the plate assemblies 11, it is possible to construct the heat exchanger 1 without the need for a casing (such as the casing 108 of the prior art heat exchanger 101) to contain one of the fluids. This can be especially advantageous when the heat exchanger 1 is used as an EGR cooler and the hot exhaust is circuited through the heat exchanger 1 as the first fluid. The damaging structural stresses that can otherwise be caused by competing thermal expansion rates between hot tubes and a cooler casing are thereby minimized or avoided in the heat exchanger 1. The inventors have found that fatigue cracking at the joints between the tubes 10 and the header 9 at the hot inlet end of the EGR cooler are less likely to occur when the EGR cooler is constructed as the heat exchanger 1, as compared to the prior art heat exchanger 101.

In lieu of a casing, side plates 8 (FIG. 2) are provided at opposing ends of the stack 30, and can provide solid support for the stack 30. In addition, the side plates 8 can be used to provide mounting features for the heat exchanger 1, as well as to provide rigid support for the connection of plumbing lines to the second fluid ports 6 and 7.

The side plates 8 can be part of the metallurgically joined stack 30, and are preferably joined to the outermost ones of either the tubes 10 or the plate assemblies 11. Optionally, the side plates 8 can be joined to the outermost tubes 10 or plate assemblies 11 with a structure 12 arranged therebetween. Stresses due to differing thermal expansion rates between a side plate 8 and the joined tube 10 or plate assembly 11 can be avoided by the inclusion of compliant or self-breaking features 25 in the side plates 8.

Preferably, the structures 12 are constructed of a material with relatively high thermal conductivity. In some embodiments the structures 12 are formed from a ferritic or austenitic steel in order to strike a balance between, on the one hand, the desire for high thermal conductivity, and on the other hand, the need for a material capable of surviving the high operational temperatures of the heat exchanger 1. In other embodiments (such as may be used in applications that do not have such high temperature requirements) a more thermally conductive material such as copper or aluminum can be used. In any event, the thermal conductivity of the material, coupled with the high spacing density of the corrugations, allows the structures 12 to serve as thermally conductive bridges between the tubes 10 conveying the first fluid and the plate assemblies 11 conveying the second fluid, so that heat can be transferred between the fluids.

The structures 12 prevent regions of elevated mechanical stresses that would otherwise occur in a direct metallurgical joint between the flat wall sections 17 of the plate assemblies 11, and the flat walls 16 of the tubes 10. Such stresses would otherwise be brought about by the cyclically occurring steep temperature gradients through the joined wall when, for example, the first fluid is a hot recirculated exhaust gas with a cyclic flow rate and the second fluid is a substantially colder coolant. The convolutions of the structures 12 introduce a sacrificial fatigue location for such thermal cycling in the flanks between the crests and troughs 29. Thermal cycle testing has shown that fatigue cracking occurs in the structures 12 near the hot end of the heat exchanger 1.

As cracking occurs in the structures 12, the thermally induced stresses are relieved. By having this sacrificial fatigue occur within the gaps 31 between the plate assemblies 11 and the tubes 10, the containment of neither of the fluids is compromised. As a result, the fatigue cracking in the structure 12 does not prohibit continued operation of the heat exchanger 1, and actually extends the life of the heat exchanger 1. In order to facilitate the preferential cracking of the structure 12 instead of the plate assemblies 11 and the tubes 10, the material thickness of the structures 12 is preferably smaller than the material thickness of either the walls 16 or the wall sections 17. In some highly preferable embodiments the material thickness of the structures 12 is no more than half the material thickness of the walls 16, the wall sections 17, or both.

Additional benefits can be realized through the presence of the structures 12 in some applications. It may be preferable, in some embodiments, to ensure that contact between the first and second fluids is avoided. As one example, the heat exchanger can be especially useful in recovering the waste heat from an exhaust gas recirculation flow by transferring that heat to a working fluid operating in a Rankine cycle system. In some cases, such a working fluid can be a HCFC refrigerant, which contains fluorinated hydrocarbons. If such a fluorinated hydrocarbon were to leak into the EGR flow and enter the combustion chamber of the engine, it would be converted by the high combustion temperatures to potentially deadly gases that would then be discharged through the exhaust. In some other cases, the working fluid can be an alcohol or other combustible fluid (including, but not limited to, ethanol, methanol, propane, butane, toluene, and naphthalene). If such a combustible working fluid were to leak into the EGR flow and enter the combustion chamber of the engine, unintended fueling of the engine could occur, potentially leading to an unsafe engine runaway condition.

With the above described construction of the heat exchanger 1, the possibility of a cross-leak between the first and second fluids is greatly minimized. Even if a leak were to occur, either in a wall of one of the tubes 10 or a wall of one of the plate assemblies 11, the fluid would leak into the gap 31 and not into the other fluid. In preferable embodiments, the first and second fluids would both be operating at a pressure that is greater than the pressure in the gap 31 (which is usually, but not necessarily always, atmospheric pressure). In such embodiments, a cross-leak between the first and second fluids is highly unlikely even if a leak were to develop in both one of the tubes 10 and one of the plate assemblies 11, as both fluids would leak to the lower pressure found in the gap 31.

The structure 12 as described above and in the appended figures provides additional benefits in providing separation between the fluids in the case of a leak in both one of the tubes 10 and one of the plate assemblies 11. As best seen in FIG. 5, the crests and troughs 29, bonded in alternating succession to a wall 16 of a tube 10 and a wall section 17 of a plate assembly 11, provide a plurality of parallel arranged channels 33 extending in a width direction of the heat exchanger 1 (i.e. the direction wherein the short walls 18 of the tubes 10 are spaced apart). Each of the channels 33 is bounded on one side by one, but not both, of a wall 16 and a wall section 17, and on the other side by a crest or trough 29. Thus, even if a failure were to occur in both a wall section 17 of a tube assembly 11 and in an adjacent wall 16 of a tube 10, the wall section 17 and the wall 16 being separated by the gap 31, each of the first and second fluids would leak into separate ones of the channels 33. As a result, the hypothetical leak path between the two fluids would need to extend through each of those two channels 33, rather than through the relatively small gap 31.

The foregoing notwithstanding, the structures 12 can be embodied in other ways without deviating from the present invention. For example, the structures 12 might alternatively comprise a machined plate of a thickness approximately equal to the gap 31, the plate having channels provided therein. As another example, the structures 12 might alternatively comprise a formed wire placed within the gaps 31.

In some preferable embodiments, the flow paths for the second fluid are spaced a distance 15 away from the header 9 at at least one end of the heat exchanger 1, preferably at the hot end. This minimizes the thermal gradient between the header 9 (which is exposed only to the first fluid in the manifold 4 or 5) and the tube wall 16 in the heat transfer region, and provides a length of the tube 10 wherein the differential thermal expansion between, on the one hand, the header 9 and the ends of the tubes 10, and on the other hand, the joined tubes 10 and plate assemblies 11, can be compensated for without imposing severe mechanical stresses on the tubes 10.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A heat exchanger to transfer heat between a first and a second fluid, comprising:

first and second flat headers, each with at least one opening and each arranged at opposing ends of the heat exchanger;

a first flow conduit fluidly connecting the first and second flat headers via the at least one opening of each of the headers to allow for a flow of the first fluid through the heat exchanger, the first flow conduit being bounded by a first wall section extending between the first and second headers;

a second flow conduit to allow for a flow of the second fluid through the heat exchanger, the second flow conduit being bounded by a second wall section spaced apart from the first wall section to define a gap therebetween; and a thermally conductive structure arranged within the gap and joined to the first and second wall sections to transfer heat therebetween, wherein the thermally conductive structure is isolated from the first fluid by the first wall section and from the second fluid by the second wall section;

wherein the second flow conduit is spaced away in a first flow conduit axial direction from at least one of the first and second headers, the second flow conduit being defined by a flow path for the second fluid.

2. The heat exchanger of claim 1, further comprising a plurality of channels arranged within the gap and defined by the thermally conductive structure and the first and second wall sections.

3. The heat exchanger of claim 2, wherein said opposing ends of the heat exchanger define a heat exchanger length direction, the first flow conduit extends in the length direction and the channels extend in a direction that is transverse to the length direction and parallel to the first and second wall sections.

4. The heat exchanger of claim 2, wherein each one of the plurality of channels is bounded by exactly one of the first and second wall sections.

5. The heat exchanger of claim 1, wherein the thermally conductive structure comprises a corrugated sheet.

6. The heat exchanger of claim 1, wherein the thermally conductive structure comprises a plurality of flanks, wherein a thickness of each of the plurality of flanks is no more than half of a thickness of one of the first and the second wall sections.

7. A heat exchanger comprising:

first and second headers arranged at opposing ends of the heat exchanger;

a plurality of flat tubes extending between the first and second headers, a first end of each one of the plurality of flat tubes extending through one of a plurality of corresponding tube slots provided in the first header, a second end of each one of the plurality of flat tubes extending through one of a plurality of corresponding tube slots provided in the second header;

a plurality of plate assemblies arranged between the first and second opposing headers, the plurality of plate assemblies being interleaved with the plurality of flat tubes; and a plurality of thermally conductive structures arranged in gaps defined between adjacent ones of the flat tubes and plate assemblies, each one of the plurality of thermally conductive structures joining opposing external surfaces of the flat tubes and plate assemblies to transfer heat therebetween;

wherein the plurality of plate assemblies is spaced away from at least one of the first and second opposing headers.

8. The heat exchanger of claim 7, further comprising a plurality of channels arranged between adjacent ones of the flat tubes and plate assemblies and defined by the thermally conductive structures and the external surfaces of the flat tubes and plate assemblies.

9. The heat exchanger of claim 8, wherein the channels extend in a direction that is transverse to a tube-axial direction of the plurality of flat tubes.

10. The heat exchanger of claim 8, wherein the plurality of channels includes a first plurality of channels bounded by external surfaces of the plurality of flat tubes and not bounded by external surfaces of the plurality of plate assemblies, and a second plurality of channels bounded by external surfaces of the plurality of plate assemblies and not bounded by external surfaces of the plurality of flat tubes.

11. The heat exchanger of claim 7, wherein the plurality of thermally conductive structures comprises a plurality of corrugated sheets.

* * * * *